United States Patent [19]

Graham

[11] Patent Number: 4,977,652

[45] Date of Patent: Dec. 18, 1990

[54] TREE FOREST CEMETERY

[76] Inventor: Gray Graham, 5454 Peterson La. #1030, Dallas, Tex. 75240

[21] Appl. No.: 434,292

[22] Filed: Nov. 13, 1989

[51] Int. Cl.[5] ..... A61G 17/00

[52] U.S. Cl. ..... 27/1; 27/35

[58] Field of Search ..... 27/1, 7, 35

[56] References Cited

U.S. PATENT DOCUMENTS

| | | | |
|---|---|---|---|
| 2,009,724 | 7/1935 | Bircher . | |
| 2,085,859 | 4/1937 | Martin . | |
| 3,254,773 | 6/1966 | Diem . | |
| 3,529,730 | 9/1970 | Thompson . | |
| 3,581,452 | 6/1971 | Jalbert | 27/1 X |
| 3,772,826 | 11/1973 | Ferver . | |
| 3,898,718 | 8/1975 | Eubank | 27/35 |
| 3,940,894 | 3/1976 | Nunes | 52/129 |
| 4,607,417 | 8/1986 | Hancovsky . | |
| 4,669,236 | 6/1987 | Martin . | |

FOREIGN PATENT DOCUMENTS

| | | | |
|---|---|---|---|
| 2361922 | 6/1975 | Fed. Rep. of Germany | 52/136 |

*Primary Examiner*—Richard E. Chilcot, Jr.
*Attorney, Agent, or Firm*—Price, Heneveld, Cooper, DeWitt & Litton

[57] ABSTRACT

A tree forest cemetery and method of interment of cremated remains in which cremated remains are each contained in an urn capsule which in turn is lowered into a vault buried in the ground. Preferably, a needleleaf tree is planted over the vault so as to provide a cemetery with small lots with a tree located in each lot. The overall effect is a beautiful memorial and the replenishment of trees on the earth for environmental purposes.

7 Claims, 1 Drawing Sheet

TREE FOREST CEMETERY

This invention relates to a tree forest cemetery or a part thereof, comprising an entirely new and novel concept for the interment of cremated remains.

BACKGROUND OF THE INVENTION

Many different frame constructions, depositories, memorial holders and storage systems have been devised for the interment of cremated remains for memorialization purposes. Decorative memorial urns have been designed for storing the cremated remains in a repository structure. However, there has always been a demand for unique and different ways of memorializing a deceased person. To my knowledge, none of these memorializing structures have involved the use of nature in a way that not only would the person be memorialized by a living memorial but many generations would be served by improving the world conditions in which we live.

BRIEF SUMMARY OF THE INVENTION

In accordance with the present invention, I have conceived memorializing deceased individuals, in fact, an entire family of deceased individuals, by providing a cemetery plot that may be divided into a number of lots, one for each family and providing a memorial tree forest by burying an airtight and moisture free vault preferably in the middle of each lot below the surface of the ground, allowing sufficient depth for planting a needleleaf tree above the vault. A tube is attached to the vault and extends at an angle or slant toward the surface of the ground providing communication between the tube and the vault so that separate urn capsules can be moved downwardly through the tube into the receptacle which constitutes the Family Vault. The tube has a removable cover at the surface of the ground so that each individual of the family, as he or she becomes deceased, is cremated, placed in a urn capsule and lowered into the tube so as to be interned within the Family Vault located under the needleleaf tree. This cremation cemetery formed of a number of lots, each with a tree approximately in the center, forms a forest which not only forms a beautiful memorial forest but replenishes the number of trees on the earth which is so essential for replenishing the environment. Thus, my invention serves a two-fold purpose of providing a beautiful memorial and helping to replenish trees for environmental purposes. This concept may be used in any existing cemetery.

These objects of my invention will become more evident by the following detailed description in conjunction with the appended drawings.

Figure 1:
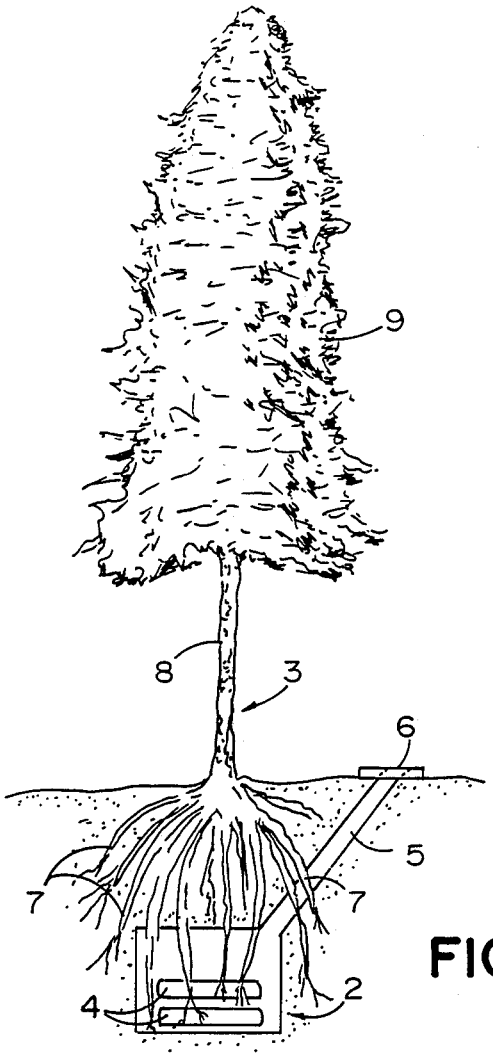
FIG. 1 a side, elevational, cross-sectional illustration of my invention with its specific root structure in with the Family Vault.
Figure 2:
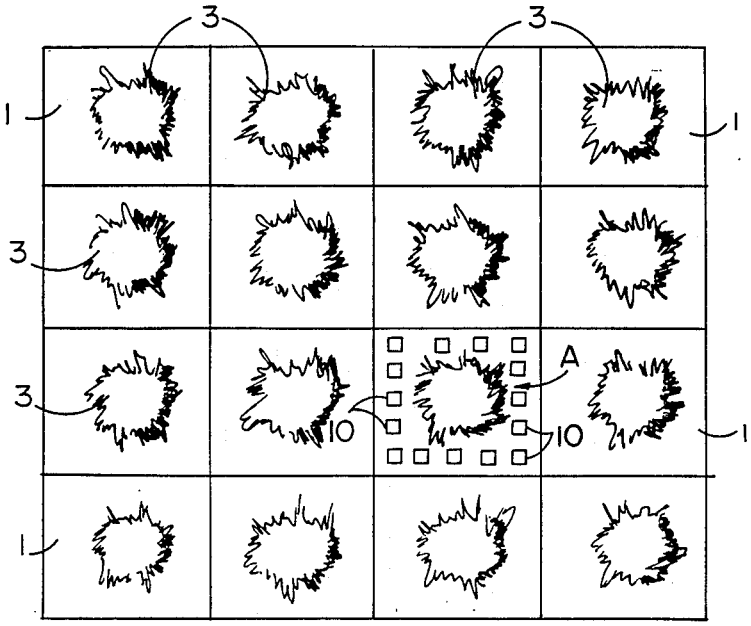
FIG. 2 is an outline of a cremation cemetery disclosing one of a plurality of lots forming the cemetery.

Referring specifically to the drawings, FIG. 2 discloses a cemetery plot comprising a plurality of lots 1 in which is buried a container 2 designated in FIG. 1 as a "Family Vault". Planted over container 2 is the tree 3.

The Family Vault 2 is constructed of a material which will not decompose within the earth. Such material is cement, plastic, fiberglass or any other well known material from which many burial vaults are now being constructed. The size of the vault 2 is sufficiently large to easily receive a predetermined number of urn capsules 4 which preferably are cylindrical in shape and approximately 5 inches in diameter and 15 inches long so as to contain 200–300 cubic inches. A hollow tube 5 extends at an angle from vault 2 to the surface of the ground and has a removable cover 6, that is airtight and moisture free. Tube 5 is of a diameter for receiving the urn capsules 4 so that when inserted in tube 5 the capsules slide into the Family Vault 2. Tube 5 is constructed of the same material as container 2 so that it also will not deteriorate.

The needleleaf trees 3 can constitute a variety of needleleaf trees, such as pine, fir and spruce. This type of tree is a well-known tree which preferably is 3–5 feet tall when planted over the vault 2. Such trees mature to reach heights of over 100 feet. It has been known that blue spruce grow to over 100 feet and reach maturity well over 300 years. The Douglas fir used each year as Christmas trees at 5–10 years of age, if allowed to grow, could reach heights of 100 feet in 50 years. Needleleaf trees have what they refer to as a "heart root" wherein the roots 7 grow outwardly and downwardly as disclosed in FIG. 1 so that they will not interfere or destroy the Family Vault 2 but extend to the side of and around it as disclosed. The trunks 8 of most needleleaf trees grow straight up. The branches 9 grow outwardly from the trunk and at the top are shorter than those further down which gives the tree a spire-like shape as disclosed. These characteristics of the needleleaf tree makes it exceptionally suitable for my cremation cemetery.

As disclosed in FIG. 2, the lots of my cemetery plot need not be very large since the trees grow straight up and the branches very seldom extend too far out from the trunk as do other hardwood trees, such as maples, oaks and the like. The lots 1 should be sufficiently large so that the trees 2 have adequate space to grow.

The trees 3 are preferably located in the center of each lot and, thus, are arranged in rows so as to give an orderly appearance. The needleleaf trees 3 have another what I consider to be an important symbol, and that is they always grow upwardly toward God to remind Him that the person in interment attempted on earth to prepare himself or herself for a better life ahead.

The trees 3 also serve many necessary and enjoyable purposes to counteract the so-called "greenhouse effect" by absorbing carbon dioxide and producing oxygen through photosynthesis.

Figure 3:
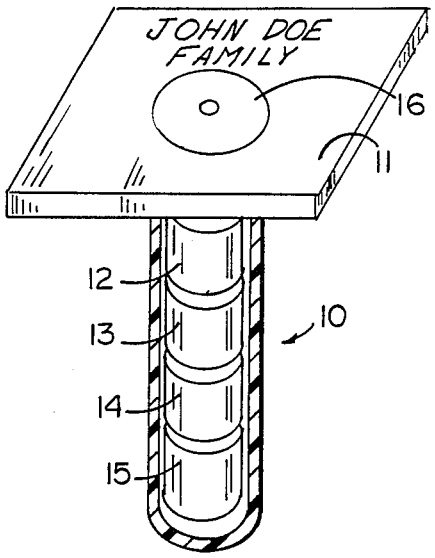
FIG. 3 is a perspective view of a separate repository or vault structure which can be utilized in the cremation cemetery of my invention.

In accordance with another aspect of my invention, I have conceived that the lots, such as disclosed by Lot "A", can include a number of interment vault such as disclosed by the vault 10 of FIG. 3. The number of such vault can be few or very many, as disclosed on Lot "A". This vault is buried in the ground and has a marker 11 attached thereto at the top by any suitable means, such as being formed integral therewith. Marker 11 can be a small plaque with the family name and also the names of the deceased members of the family represented by the separate urn capsules 12, 13, 14 and 15. The vault 10 has a cover 16 which is removable for inserting the urn capsules in the vault.

Vault 10 is buried in the ground, at the corners or along the sides of the lot as disclosed by Lot "A" in FIG. 2 or along the road (not shown) running through the cemetery. Vault 10 provides for a substantial number of internments on a relatively small lot while at the same time the beauty of the trees arranged in each lot is not lost.

It should be understood that in relation to my tree cemetery of FIGS. 1 and 2, the Family Vault 2 can be buried and the tree planted prior to the decease of any of the family members, and as the members become deceased, their cremated remains are inserted in the Family Vault by removing the cover 6 and lowering the urn capsules 4 into the tube 5 from where it slides into the Family Vault 2.

It should be evident from the above description of my invention that I have provided a unique arrangement for the interment of cremated remains in a cremation cemetery and any existing cemetery. This unique arrangement provides for a memorial forest that is not only beautiful but replenishes the tree supply which is so essential for the environmental purposes as described above. In addition, it conserves the space usually required by outdoor burial cemeteries.

It should be understood that although I have disclosed preferred embodiments of my invention, such embodiments are capable of being modified within a range of equivalents without departing from the spirit of the invention which is to be understood as broadly set forth in the appended claims.

The embodiments of the invention in which an exclusive property or privilege is claimed are defined as follows:

1. A cremation cemetery comprising:

a plot of land divided into a plurality of lots each having located therein a vault buried in the ground with a needleleaf tree planted above it so that the roots of said tree grow around the sides of said vault; and a tube attached to and communicating with said vault, said tube extending at an angle from said vault to a location above said ground and on the side of said tree whereby urns containing cremated remains can be lowered into said tube and placed therein into said vault.

2. The cemetery of claim 1 in which a removable cover is located on the top end of said tube.

3. The cremation cemetery of claim 1 in which additional separate vault are buried on at least one of said lots, said vault having a removable cover accessible from above the ground, said vault being of a shape and size for receiving a plurality of urns containing cremated remains.

4. The cremation cemetery of claim 3 in which said separate vault include a marker integral therewith.

5. A cemetery therein a vault buried in the ground with a needleleaf tree planted above it so that the roots of said tree grow around the sides of said vault; and a tube attached to and communicating with said vault, said tube extending at an angle from said vault to a location above said ground and on the side of said tree whereby urns containing cremated remains can be lowered into said tube and placed therein into said vault.

6. The cremation cemetery of claim 1 in which the trees are located in the approximate center of said lots.

7. The cemetery of claim 5 in which the tree is located in the approximate center of said lot.

* * * * *

UNITED STATES PATENT AND TRADEMARK OFFICE

CERTIFICATE OF CORRECTION

PATENT NO. : 4,977,652

DATED : December 18, 1990

INVENTOR(S) : Gray Graham

It is certified that error appears in the above-identified patent and that said Letters Patent is hereby corrected as shown below:

Col. 1, line 58;
After "in" insert --combination--;

Col. 4, line 20;
After "cemetery" insert --lot having located--.

Signed and Sealed this

Ninth Day of June, 1992

*Attest:*

DOUGLAS B. COMER

*Attesting Officer*

*Acting Commissioner of Patents and Trademarks*